US010099098B2

(12) United States Patent
Snyder et al.

(10) Patent No.: US 10,099,098 B2
(45) Date of Patent: Oct. 16, 2018

(54) GOLF CLUB ORGANIZER APPARATUS

(71) Applicant: Blue Holly LLC, Seneca, SC (US)

(72) Inventors: Bruce A Snyder, Seneca, SC (US); Ken Myers, Seneca, SC (US)

(73) Assignee: Blue Holly LLC, Seneca, SC (US)

( * ) Notice: Subject to any disclaimer, the term of this patent is extended or adjusted under 35 U.S.C. 154(b) by 22 days.

(21) Appl. No.: 15/666,265

(22) Filed: Aug. 1, 2017

(65) Prior Publication Data

US 2018/0028884 A1 Feb. 1, 2018

Related U.S. Application Data

(60) Provisional application No. 62/369,302, filed on Aug. 1, 2016.

(51) Int. Cl.

| | |
|---|---|
| ***A63B 55/00*** | (2015.01) |
| ***A63B 55/10*** | (2006.01) |
| ***A63B 55/40*** | (2015.01) |

(52) U.S. Cl.

CPC ..... *A63B 55/10* (2013.01); *A63B 55/00* (2013.01); *A63B 55/40* (2015.10)

(58) Field of Classification Search

CPC ..... A63B 55/00; A63B 55/10; A63B 55/40; A63B 55/408; A63B 2055/408

USPC ..... 206/315.2, 315.3, 315.6, 315.4

See application file for complete search history.

(56) References Cited

U.S. PATENT DOCUMENTS

| | | | | | |
|---|---|---|---|---|---|
| 492,304 | A * | 2/1893 | Markle | A47F 3/10 | 206/317 |
| 1,418,093 | A * | 5/1922 | Parmater | A63B 55/10 | 211/15 |
| 1,761,088 | A * | 6/1930 | Pryde | A47F 5/04 | 211/163 |
| 2,024,484 | A * | 12/1935 | Smith | A63B 55/10 | 224/919 |
| 2,367,234 | A * | 1/1945 | Mitchell | A63B 55/10 | 206/315.2 |
| 2,890,061 | A * | 6/1959 | Watson | A63B 55/60 | 280/13 |
| 3,172,585 | A * | 3/1965 | Mahaney | A63B 55/10 | 294/143 |
| 3,425,708 | A * | 2/1969 | Sato | A63B 55/60 | 280/47.19 |
| 3,531,136 | A * | 9/1970 | Mobley | B62B 1/14 | 280/30 |

(Continued)

*Primary Examiner* — Kimberley S Wright

(74) *Attorney, Agent, or Firm* — The Van Winkle Law Firm; William G. Heedy; David M. Carter

(57) ABSTRACT

A golf club organizer system includes a plurality of club retaining cradles each being radially displaced from each other about a vertical support member, wherein the club retaining cradles is rotatable about the vertical support member; the plurality of golf club retaining cradles each being sized for partially engaged receipt of a golf club head; a plurality of clip members each being sized for engaged receipt of a portion of the shaft of one of the golf clubs; a fixed grip presentation cam for displacing one of the clip members from a normal, resting position to an extraction position as the plurality of club retaining cradles are rotated; and wherein a user may rotate the plurality of club head cradles such that a selected one of the plurality of club retaining cradles is in the extraction position for permitting the user to remove or insert the corresponding golf club.

12 Claims, 7 Drawing Sheets

(56) References Cited

U.S. PATENT DOCUMENTS 4,673,082 A * 6/1987 Hemme ..... A63B 55/00 206/315.3
4,750,617 A * 6/1988 Anderson ..... A63B 55/00 206/315.2
4,852,896 A * 8/1989 Mills ..... A63B 55/00 206/315.2
4,915,221 A * 4/1990 Spangler ..... A63B 55/00 206/315.3
5,279,414 A * 1/1994 Brasher ..... A63B 55/00 206/315.3
5,672,145 A * 9/1997 Pollington ..... B23Q 3/15526 211/1.52
5,842,564 A 12/1998 Clement
6,053,312 A * 4/2000 Smith ..... A63B 55/00 206/315.6
6,102,202 A * 8/2000 Jones ..... A63B 55/00 206/315.6
6,305,534 B1 * 10/2001 Neal ..... F41B 5/063 206/315.11
6,352,154 B1 * 3/2002 Miura ..... A63B 55/00 206/315.6
6,381,998 B1 * 5/2002 Good ..... A63B 55/00 70/58
6,615,982 B1 * 9/2003 Stewart ..... A63B 55/00 206/315.3
6,929,124 B2 * 8/2005 Kawasaki ..... A63B 55/40 206/315.2
7,395,939 B2 * 7/2008 Morris ..... A47K 1/09 182/70
8,302,787 B2 * 11/2012 Tobey ..... A61J 1/16 211/77
8,567,640 B1 * 10/2013 Johnson-Lofton .... A61J 7/0069 211/59.2
2001/0000617 A1 * 5/2001 Tracy ..... B60N 3/10 248/154
2003/0106817 A1 * 6/2003 Buckley ..... A63B 55/00 206/315.6
2007/0057001 A1 * 3/2007 Wang ..... B60R 9/06 224/536
2007/0084810 A1 * 4/2007 Morris ..... A47K 1/09 211/65
2008/0006547 A1 * 1/2008 Pace ..... A63B 55/10 206/315.2
2011/0031199 A1 * 2/2011 Tobey ..... A61J 1/16 211/131.1
2012/0024730 A1 * 2/2012 Pittman ..... A63B 55/00 206/315.6
2014/0309053 A1 * 10/2014 Masse ..... A63B 55/10 473/287
2016/0199708 A1 * 7/2016 Pittman ..... A63B 55/00 414/811

* cited by examiner

GOLF CLUB ORGANIZER APPARATUS

RELATED APPLICATION

This application claims priority to and incorporates entirely by reference U.S. Provisional Patent Application Ser. No. 62/369,302 filed on Aug. 1, 2016.

FIELD OF THE INVENTION

This invention relates to storage of golf clubs and, more particularly, a golf club organizer for receiving and storing golf clubs therein.

BACKGROUND OF THE INVENTION

A number of apparatuses have been designed to store golf clubs, each of these apparatuses typically including a plurality of storage compartments designated for receipt of a particular club type (e.g., woods, irons etc.). A standard golf bag for storing golf clubs is shown and described in U.S. Pat. No. 1,409,323. Other golf bags have been designed to provide holding means adapted to receive and hold the clubs individually and to hold them prevent them from rattling and rubbing engagement with one another.

A considerable problem with the game of golf is the amount of time required to play a round in its entirety. Indeed, a number of initiatives set out by the United States Golf Association have been ongoing in an effort to speed up the rate of play. The majority of these initiatives, however, have an eye towards certain mental preparations (e.g. planning your shot before you get to your ball) while playing. One such problem is the club organization and management. Other golf bags have attempted to address this concern with dividers and club-specific locations within the bag to make locating the desired club easier and more efficient. Another problem is club protection, both when in transport and during play. Club heads protruding from the top of the golf bag are typically free to bang about and into one another, especially when attached to a golf cart which can encounter substantial jarring during the course of play. Yet another problem is the physical exertion required when extracting the clubs out of the top of the golf bag. All known prior art requires golfers to raise their arms over their heads repeatedly. For golfers who may have physical limitations due to shoulder damage, short stature, advanced age, etc, the act of raising the clubs several feet into the air to remove them from the bag can be problematic.

In light of the problems discussed above, there exists a need for a golf club organizer for speeding up the rate of play, better organizing and protecting of the clubs and improving club access, while providing an apparatus for securing a plurality of golf clubs thereto both for use during play and, conversely, for storage purposes.

SUMMARY OF THE INVENTION

In accordance with one form of this invention, there is provided a golf club organizer system for securing a plurality of golf clubs, the golf club organizer system including a base; a vertical support member extending upwards from the base; a plurality of club retaining cradles each being secured to the vertical support member and each of the plurality of club retaining cradles being radially displaced from each other; the plurality of golf club retaining cradles each being sized for partially engaged receipt of a corresponding head of one of the plurality of golf clubs and each of the plurality of club retaining cradles being collectively rotatable about the vertical support member; an upper support member including a plurality of clip guides each including a distal end and each being interspersed with corresponding ones of a plurality of clip members, each of the plurality of clip members being sized for engaged receipt of a portion of the shaft of one of the plurality of golf clubs; the upper support member being coupled with the vertical support member and the upper support member being selectively rotatable; a protective shell at least partially encapsulating the base, the vertical support member, the plurality of golf club head retaining cradles and the upper support member, the protective shell further defining a cutaway slot that is sized and configured for permitting passage therethrough of a selected one of the plurality of golf clubs to and from a corresponding one of the plurality of club head cradles; a stabilizing race having an inner facing surface forming a radial path through which the distal end of each of the plurality of clip guides partially engages and radially travels therethrough when the upper support member is rotated; a grip presentation cam that is structured and disposed for displacing one of the plurality of clip members from a normal, resting position to an extraction position as the plurality of club retaining cradles are rotated, wherein the displaced one of the plurality of clip members is in radial alignment with the cutaway slot; and wherein a user may selectively rotate the upper support member such that a selected one of the plurality of club retaining cradles is in radial alignment with the cutaway slot for permitting the user to selectively and horizontally displace a correspondingly selected one of the plurality of golf clubs to and from the respective one of the plurality of golf club retaining cradles.

In accordance with another form of this invention, there is provided a golf club organizer system for securing a plurality of golf clubs, the golf club organizer system including a plurality of club retaining cradles each being radially displaced from each other about a vertical support member, wherein the plurality of club retaining cradles is rotatable about the vertical support member; the plurality of golf club retaining cradles each being sized for partially engaged receipt of a corresponding head of one of the plurality of golf clubs; a plurality of clip members each being sized for engaged receipt of a portion of the shaft of one of the plurality of golf clubs; a fixed grip presentation cam that is structured and disposed for displacing one of the plurality of clip members from a normal, resting position to an extraction position as the plurality of club retaining cradles are rotated; and wherein a user may selectively rotate the plurality of club head cradles such that a selected one of the plurality of club retaining cradles is in the extraction position for permitting the user to selectively displace a correspondingly selected one of the plurality of golf clubs to and from the selected one of the plurality of golf club retaining cradles.

In accordance with another form of this invention, there is provided a golf club organizer system for securing a plurality of golf clubs in a club head down configuration, the golf club organizer system including a plurality of club retaining cradles each being secured to a vertical support member and each of the plurality of club retaining cradles being radially displaced from each other; the plurality of golf club retaining cradles each being sized for partially engaged receipt of a corresponding head of one of the plurality of golf clubs; a plurality of clip guides each including a distal end and each being interspersed with corresponding ones of a plurality of clip members, each of the plurality of clip members being sized for engaged receipt of a portion of the shaft of one of the plurality of golf clubs; a protective shell at least partially encapsulating the vertical support member and the plurality of club head retaining cradles, the protective shell further defining a cutaway slot that is sized and configured for permitting passage therethrough of a selected one of the plurality of golf clubs to and from a corresponding one of the plurality of club head cradles; each of the plurality of club retaining cradles being collectively rotatable relative to the protective shell; a stabilizing race having an inner facing surface forming a radial path through which the distal end of each of the plurality of clip guides partially engages and radially travels therethrough during rotation; and wherein a user may selectively position the plurality of club head cradles relative to the cutaway slot such that a selected one of the plurality of club retaining cradles is in radial alignment with the cutaway slot for permitting the user to selectively and horizontally displace a correspondingly selected one of the plurality of golf clubs to and from the selected one of the plurality of golf club retaining cradles.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the golf club organizer apparatus of the present invention for use in conjunction with golf clubs 100 and, in some embodiments, golf carts, is shown and described herein and is generally indicated as 10.

Figure 1:
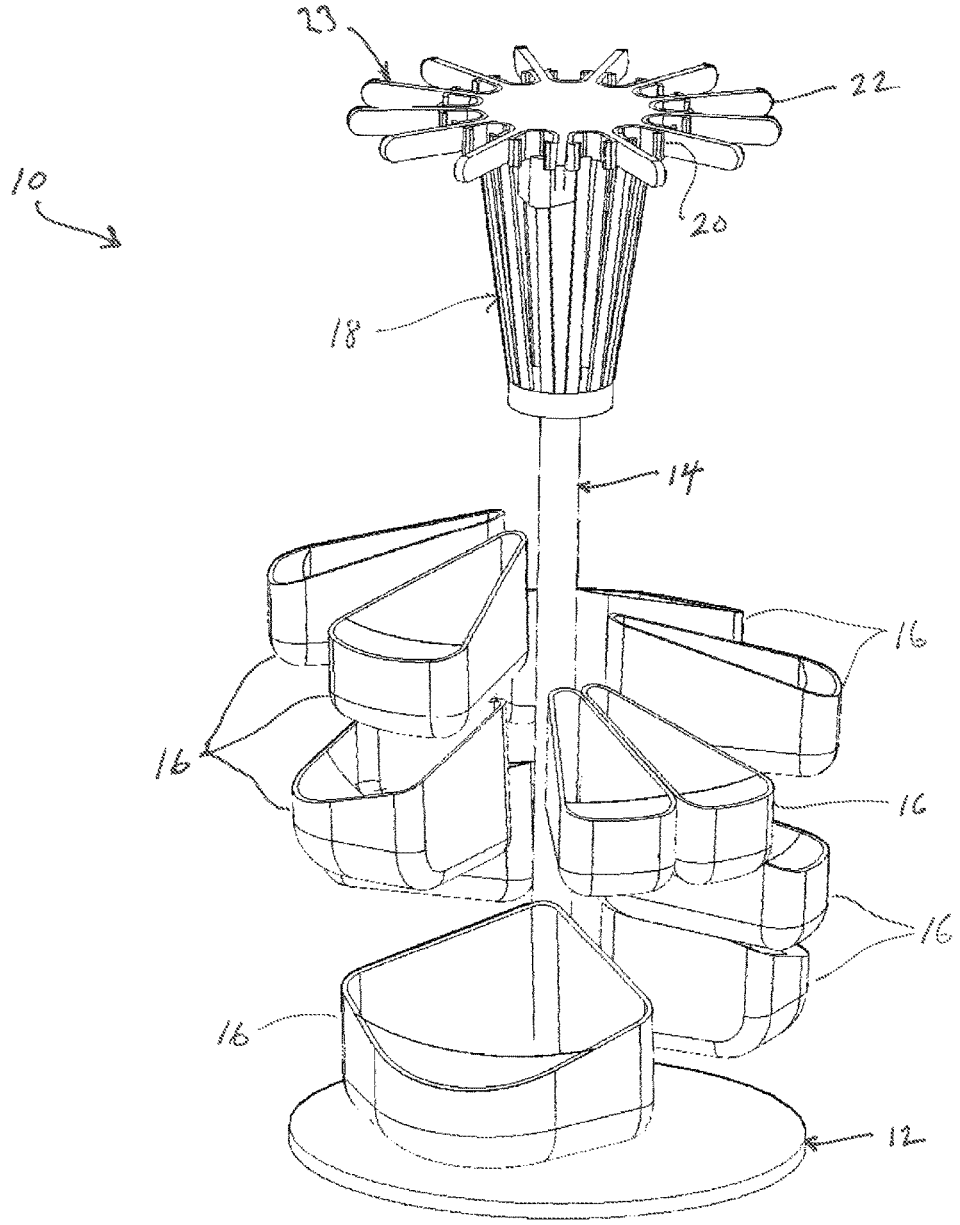
FIG. 1 is a perspective view of the golf club organizer apparatus of the present invention.
Figure 2:
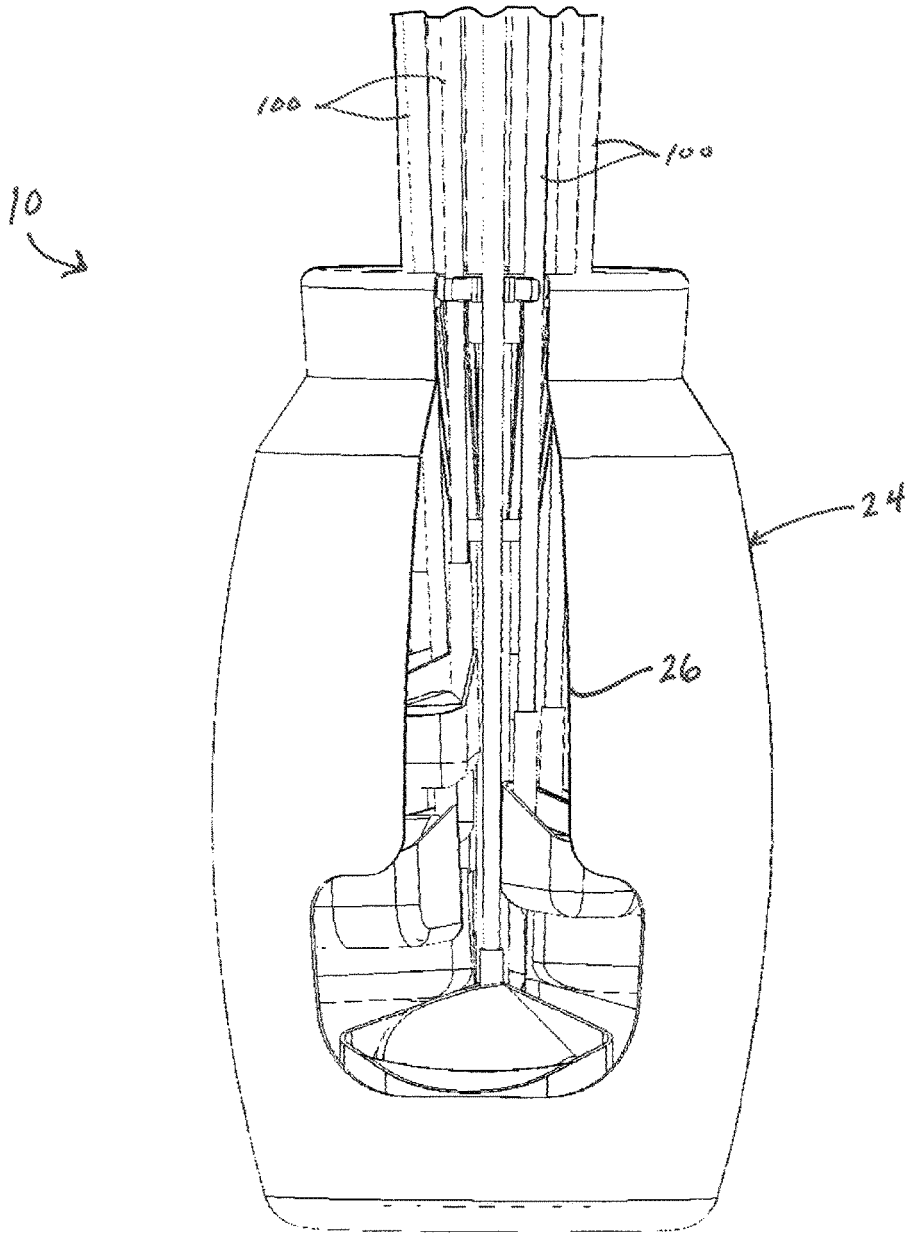
FIG. 2 is a front elevational view of the golf club organizer apparatus.

Referring initially to FIGS. 1-2, the golf club organizer apparatus 10 includes a fixed base 12 with a vertical support member 14 which is centrally held on the base 12 and having a rotating means. A plurality of golf club head cradles 16 are located around the vertical support member 14 at varying heights and angles necessary to allow the full allotment of clubs to be fitted within the circumference required to be effectively carried within the typical bag area of a golf cart. Each cradle 16 is sized for partially engaged receipt of a corresponding golf club head. Importantly, the golf club organizer apparatus 10 permits golf clubs to be selectively and horizontally removed from either of the first or second racks without having to vertically displace the golf club.

In accordance with one embodiment, an upper support member 18 generally extends radially from the vertical support member 14 and includes a plurality of clip members 20 and clip guides 22 along an annular support member 23 of the top of the upper support member 18. Each clip member 20 is structured and disposed for receipt of a portion of the shaft of a golf club 100. Referring specifically to FIG. 2, a protective shell 24 substantially surrounds the vertical pole member 14, the plurality of golf club head cradles 16, and the upper support member 18. The protective shell 24 further defines a cutaway slot 26 extending from the top of the protective shell 24 downwards. The cutaway 26 slot is sized and configured to permit passage therethrough of a golf club 100 to and from any of the plurality of golf club head cradles 16.

Figure 3:
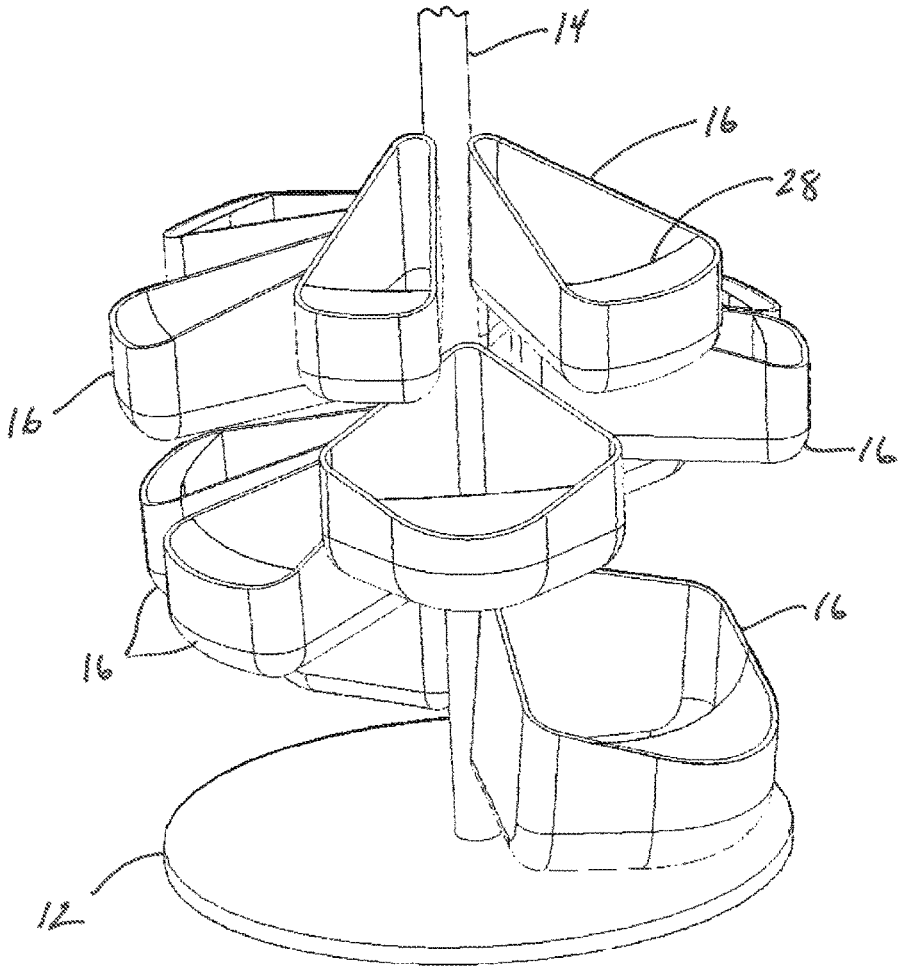
FIG. 3 is an isolated perspective view of the club head cradles.

Referring to FIG. 3, each of the plurality of golf club head cradles 16 is designed to provide a visible target area with raised side walls to assist with ease of placement of a club 100 into the apparatus 10. The sidewalls of each cradle 16 serve further to isolate clubs from adjacent clubs, thus providing protection from damage. Each of the golf club head cradles 16 includes a lip member 28 under which the toe of the club head is placed when inserting the club 100 to ensure that the club does not bounce or otherwise move outwards of the corresponding cradle 16 during use or transport. The cradles 16 may also include a brightly colored bottom pad, or be made of a colored material to further aid in sighting the club placement location.

Figure 4:
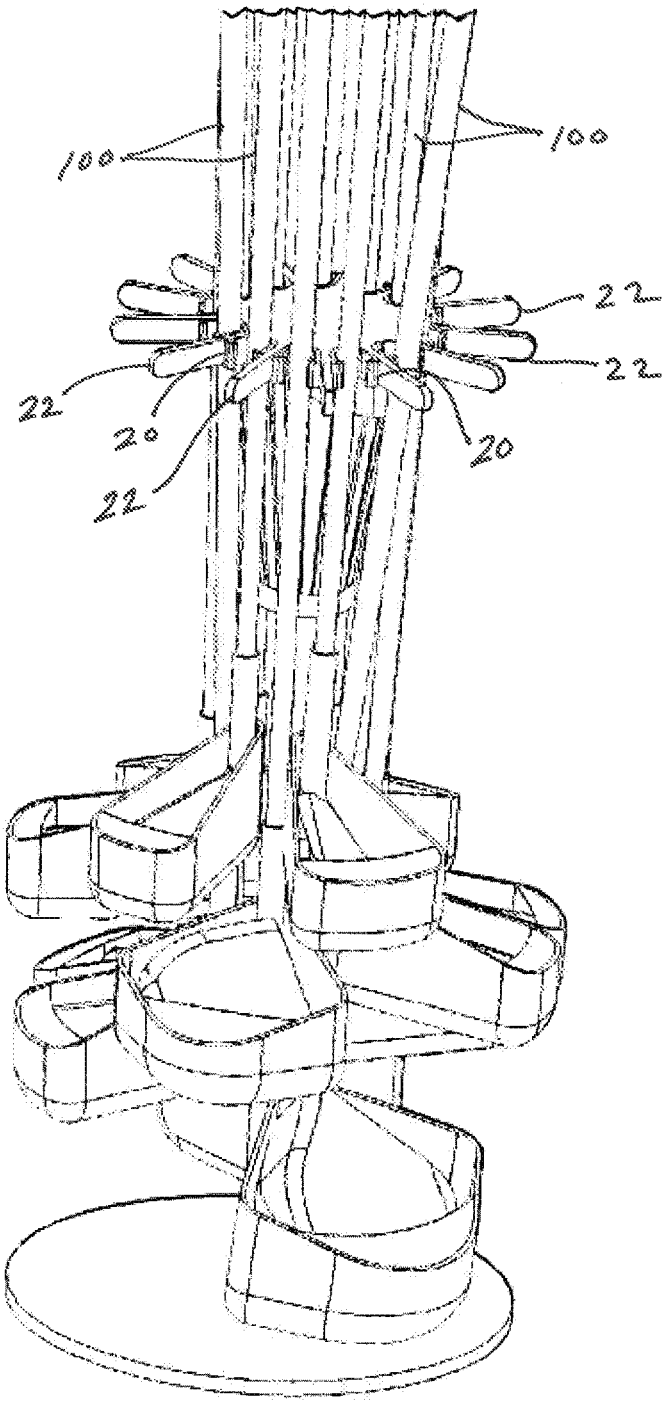
FIG. 4 is an isolated perspective view of the clip members and clip guides.

Referring to FIG. 4, the shaft retaining clip members 20 are formed from rubber or similarly elastomeric material to prevent marring of the club shafts. The clip members 20 are U-shaped with the opposing distal ends forming inward facing hooks to provide for easy entry without requiring precise targeting, while also serving to effectively contain the shaft therein without requiring undue force for either insertion or removal of the club.

Figure 5:
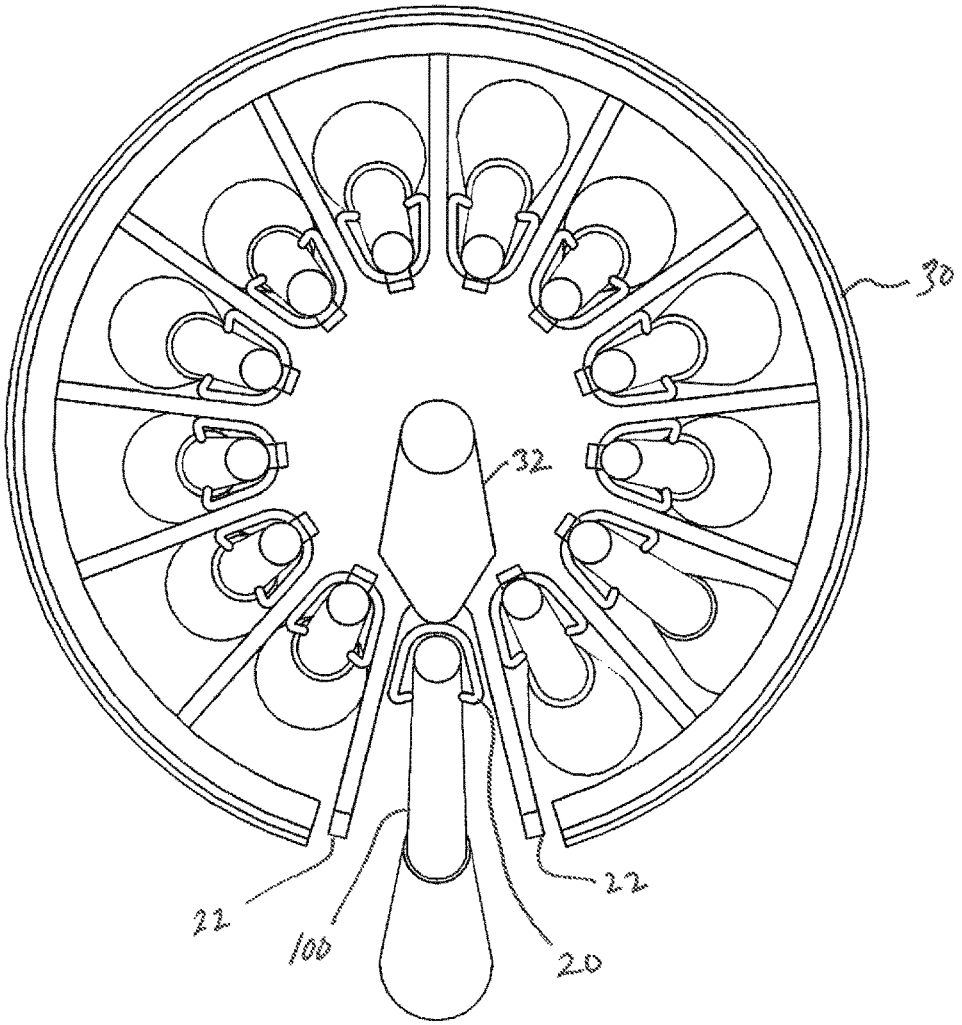
FIG. 5 is an isolated top plan view of the upper support member and including a plurality of golf clubs stored thereon.
Figure 6:
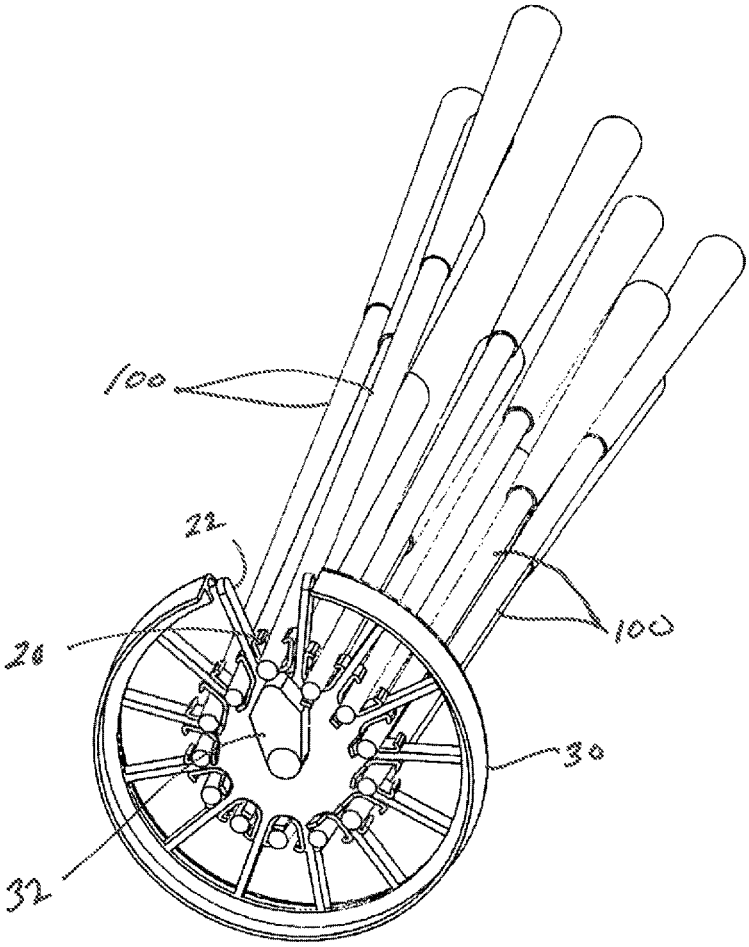
FIG. 6 is an isolated perspective view of the annular support member and including a plurality of golf clubs stored thereon.
Figure 7:
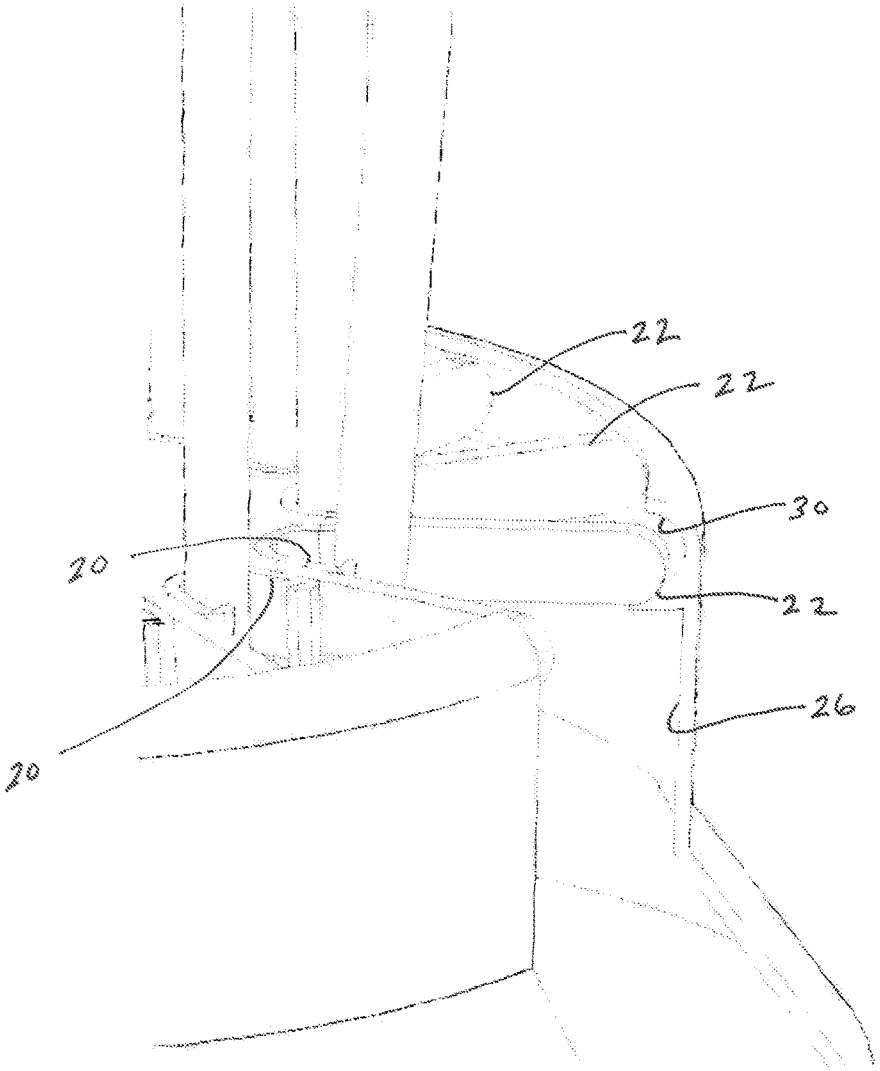
FIG. 7 is an isolated perspective view showing the clip guides passing through the radial path of the stabilizing race.

Referring to FIGS. 5-7, the upper rim of the protective shell 24 is defined by a stabilizing race 30 forming a radial path within which the clip guides 22 of the rotating upper support member 18 partially engage and travel when the upper support member 18 is rotated. A grip presentation cam 32 is affixed to the vertical support member 14 for the purpose of displacing the top of the club shaft in such a way as to present it more openly when the club 100 is at the extraction position—i.e., in alignment with the cutaway slot 26 of the protective shell 24. The grip presentation cam 32 is in a fixed position and configured to interact with the respective surfaces on the backs of the clip members 20, which are connected to the clip guides 22 using an elastomeric connecter, such that one single club grip at a time is pressed outwards and beyond the resting perimeter alignment of the club grips to create easy access for a user to grasp the selected club 100.

In operation, a user may efficiently interchange clubs to and from the stored position by rotating the rotating upper support member 18 and, as a result, the plurality of golf club head cradles 16 about the base 12, selecting the desired golf club, and exerting a linear force on the club perpendicular to and away from the vertical support member 14, i.e. horizontally pulling the club away from the vertical support member 14 and through the cutaway slot 26. Likewise, a club may be secured to the golf club organizer apparatus 10 in the stored position by placing the golf club head in a corresponding one of the plurality of golf club head cradles 16 and exerting a linear force on the club perpendicular to and towards the vertical support member 14 such that the shaft of the club 100 engages the corresponding clip member 20.

In one embodiment, the protective shell 24 rotates relative to the fixed base 12 and fixed vertical support member 14.

One embodiment of the golf club organizer apparatus 10 includes a mounting bracket (not pictured) for securing the apparatus 10 to a golf cart or other object. The mounting bracket includes at least one hook (or comparable attachment means) for hooking the mounting bracket to the golf cart structure.

While the present invention has been shown and described in accordance with several preferred and practical embodiments, it is recognized that departures from the instant disclosure are contemplated within the spirit and scope of the present invention.

What is claimed is:

1. A golf club organizer system for securing a plurality of golf clubs, said golf club organizer system comprising:

a base;

a vertical support member extending upwards from said base, said vertical support member being selectively rotatable about said base;

a plurality of club retaining cradles each being secured to said vertical support member and each of said plurality of club retaining cradles being radially displaced from each other;

said plurality of golf club retaining cradles each being sized for partially engaged receipt of a corresponding head of one of the plurality of golf clubs and each of said plurality of club retaining cradles being collectively rotatable about the vertical support member;

an upper support member including a plurality of clip guides each including a distal end and each being interspersed with corresponding ones of a plurality of clip members, each of said plurality of clip members being sized for engaged receipt of a portion of a shaft of one of the plurality of golf clubs;

said upper support member being coupled with said vertical support member and said upper support member being selectively rotatable;

a protective shell at least partially encapsulating said base, said vertical support member, said plurality of golf club head retaining cradles and said upper support member, said protective shell further defining a cutaway slot that is sized and configured for permitting passage therethrough of a selected one of the plurality of golf clubs to and from a corresponding one of said plurality of club head cradles;

a stabilizing race having an inner facing surface forming a radial path through which the distal end of each of said plurality of clip guides partially engages and radially travels therethrough when said upper support member is rotated;

a grip presentation cam that is structured and disposed for displacing one of said plurality of clip members from a normal, resting position to an extraction position as said plurality of club retaining cradles are rotated, wherein the displaced one of said plurality of clip members is in radial alignment with said cutaway slot; and wherein a user may selectively rotate said upper support member such that a selected one of said plurality of club retaining cradles is in radial alignment with said cutaway slot for permitting the user to selectively and horizontally displace a correspondingly selected one of the plurality of golf clubs to and from the selected one of said plurality of golf club retaining cradles.

2. The golf club organizer system as recited in claim 1 wherein each of said plurality of clip members are formed from an elastomeric material.

3. The golf club organizer system as recited in claim 1 wherein each of said plurality of clip members are secured to respective ones of said plurality of clip guides.

4. The golf club organizer system as recited in claim 1 wherein each of said plurality of clip members are U-shaped with opposing distal ends forming inward facing hooks.

5. A golf club organizer system for securing a plurality of golf clubs, said golf club organizer system comprising:

a plurality of club retaining cradles each being radially displaced from each other about a vertical support member, wherein said plurality of club retaining cradles is rotatable about said vertical support member;

said plurality of golf club retaining cradles each being sized for partially engaged receipt of a corresponding head of one of the plurality of golf clubs;

a plurality of clip members each being sized for engaged receipt of a portion of a shaft of one of the plurality of golf clubs;

a fixed grip presentation cam that is structured and disposed for displacing one of said plurality of clip members from a normal, resting position to an extraction position as said plurality of club retaining cradles are rotated; and wherein a user may selectively rotate said plurality of club head cradles such that a selected one of said plurality of club retaining cradles is in the extraction position for permitting the user to selectively displace a correspondingly selected one of the plurality of golf clubs to and from the selected one of said plurality of golf club retaining cradles.

6. The golf club organizer system as recited in claim 5 wherein each of said plurality of clip members are formed from an elastomeric material.

7. The golf club organizer system as recited in claim 5 wherein each of said plurality of clip members are U-shaped with opposing distal ends forming inward facing hooks.

8. The golf club organizer system as recited in claim 5 further comprising a protective shell at least partially encapsulating said vertical support member and said plurality of golf club head retaining cradles, said protective shell further defining a cutaway slot that is sized and configured for permitting passage therethrough of a selected one of the plurality of golf clubs to and from a corresponding one of said plurality of club head cradles.

9. The golf club organizer system as recited in claim 5 further comprising a plurality of clip guides each including a distal end and each being interspersed with corresponding ones of said plurality of clip members.

10. The golf club organizer system as recited in claim 9 wherein each of said plurality of clip members are secured to respective ones of said plurality of clip guides.

11. The golf club organizer system as recited in claim 9 further comprising a stabilizing race having an inner facing surface forming a radial path through which the distal end of each of said plurality of clip guides partially engages and radially travels therethrough when said upper support member is rotated.

12. The golf club organizer system as recited in claim 9 further comprising a grip presentation cam that is structured and disposed for displacing one of said plurality of clip members from a normal, resting position to an extraction position as said plurality of club retaining cradles are rotated, wherein the displaced one of said plurality of clip members is in radial alignment with said cutaway slot.

* * * * *